US009279272B2

(12) United States Patent
Noda et al.

(10) Patent No.: US 9,279,272 B2
(45) Date of Patent: Mar. 8, 2016

(54) EXTERNAL HANDLE DEVICE FOR VEHICLE DOOR

(75) Inventors: Yuichiro Noda, Miyazaki (JP); Hitoshi Kawano, Miyazaki (JP); Keita Yoshii, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 141 days.

(21) Appl. No.: 14/239,051

(22) PCT Filed: Jun. 28, 2012

(86) PCT No.: PCT/JP2012/066517

§ 371 (c)(1),
(2), (4) Date: Feb. 14, 2014

(87) PCT Pub. No.: WO2013/027486

PCT Pub. Date: Feb. 28, 2013

(65) Prior Publication Data

US 2014/0203574 A1 Jul. 24, 2014

(30) Foreign Application Priority Data

Aug. 23, 2011 (JP) ..... 2011-181648

(51) Int. Cl.
*E05B 3/00* (2006.01)
*E05B 7/00* (2006.01)
*E05B 85/16* (2014.01)

(52) U.S. Cl.
CPC . *E05B 7/00* (2013.01); *E05B 81/77* (2013.01); *E05B 85/16* (2013.01); *Y10T 292/57* (2015.04)

(58) Field of Classification Search
USPC ..... 292/336.3
See application file for complete search history.

(56) References Cited

U.S. PATENT DOCUMENTS 6,769,154 B1 8/2004 Klein et al.
7,217,899 B2 5/2007 Hidaka et al.

(Continued)

FOREIGN PATENT DOCUMENTS

CN 1676838 A 10/2005
CN 101002000 A 7/2007

(Continued)

OTHER PUBLICATIONS

Official Communication (Decision of Granting a Patent ) dated Jun. 25, 2014 issued in corresponding JP Patent Application 2011-181648.

(Continued)

*Primary Examiner* — Mark Williams
(74) *Attorney, Agent, or Firm* — Carrier Blackman & Associates, P.C.; William D. Blackman; Joseph P. Carrier

(57) ABSTRACT

An external handle device for a vehicle door is provided in which an operating handle comprising a handle main body that has formed therein a housing recess having a substantially U-shaped cross section and a handle cover that is secured to the handle main body so as to cover the housing recess is disposed so as to be operable on an outer face side of the vehicle door, and an electronic component unit formed by covering at least an electronic component with a jacket member is housed within the housing recess, wherein an extending portion is provided integrally with the jacket member, which is formed from a resilient material, the extending portion being sandwiched between abutting parts of the handle main body and the handle cover. Such configuration prevents rubbing occurring between abutting parts of the handle main body and the handle cover while eliminating necessity for an adhesive.

7 Claims, 7 Drawing Sheets

(56) References Cited

U.S. PATENT DOCUMENTS

| | | | | |
|---|---|---|---|---|
| 7,300,190 | B2 | 11/2007 | Nitawaki et al. | |
| 7,422,258 | B2 | 9/2008 | Schindler et al. | |
| 7,445,257 | B2 * | 11/2008 | Muller | E05B 81/78 292/336.3 |
| 7,598,469 | B2 | 10/2009 | Tanimoto et al. | |
| 2011/0012378 | A1 | 1/2011 | Ueno et al. | |
| 2011/0025522 | A1 * | 2/2011 | Peschl | E05B 81/76 340/686.6 |

FOREIGN PATENT DOCUMENTS

| | | | |
|---|---|---|---|
| DE | 102004019627 | A1 | 12/2004 |
| FR | 2217784 | A1 | 9/1974 |
| FR | 2217784 | A1 | 10/1974 |
| JP | 2004095848 | A | 3/2004 |
| JP | 2005-256453 | A | 9/2005 |
| JP | 2008-196147 | A | 8/2008 |
| JP | 2011-039027 | A | 2/2011 |

OTHER PUBLICATIONS

Official Communications dated Apr. 23, 2015 in regards to corresponding Chinese Patent Application No. 201280040965.2.

Official Communications dated Aug. 18, 2014 corresponding to European Application No./Patent No. 12825303.6/2749718.

* cited by examiner

EXTERNAL HANDLE DEVICE FOR VEHICLE DOOR

TECHNICAL FIELD

The present invention relates to an external handle device for a vehicle door in which an operating handle that includes a handle main body that has formed therein a housing recess having a substantially U-shaped cross section that is open on the side opposite to the vehicle door and a handle cover that is secured to the handle main body so as to cover the housing recess is disposed so as to be operable on an outer face side of the vehicle door, and an electronic component unit formed by covering at least an electronic component with a jacket member is housed within the housing recess.

BACKGROUND ART

Such an external handle device for a vehicle door is already known from Patent Document 1.

RELATED ART DOCUMENTS

Patent Documents

Patent Document 1: Japanese Patent Application Laid-open No. 2005-256453

DISCLOSURE OF INVENTION

Problems to be Solved by the Invention

However, in the device disclosed by Patent Document 1 above, when operating an operating handle, rubbing occurs between abutting parts of a handle main body and a handle cover that are secured to each other so as to form in cooperation the operating handle, and there is a possibility that the rubbing will generate noise. In order to prevent the generation of noise due to such rubbing, coating the abutting parts of the handle main body and the handle cover with an adhesive and fixing them could be considered.

However, when an adhesive is used, not only does the cost increase, but it also becomes necessary to carry out an operation of coating with the adhesive, thus increasing the number of operation steps. Furthermore, the adhesive requires time for curing, the operation of a subsequent step cannot be carried out immediately, and the operation time increases.

The present invention has been accomplished in light of such circumstances, and it is an object thereof to provide an external handle device for a vehicle door that prevents rubbing from occurring between abutting parts of a handle main body and a handle cover while eliminating the necessity for an adhesive.

Means for Solving the Problems

In order to attain the above object, according to a first aspect of the present invention, there is provided an external handle device for a vehicle door in which an operating handle comprising a handle main body that has formed therein a housing recess having a substantially U-shaped cross section that is open on the side opposite to the vehicle door and a handle cover that is secured to the handle main body so as to cover the housing recess is disposed so as to be operable on an outer face side of the vehicle door, and an electronic component unit formed by covering at least an electronic component with a jacket member is housed within the housing recess, characterized in that an extending portion is provided integrally with the jacket member, which is formed from a resilient material, the extending portion being sandwiched between abutting parts of the handle main body and the handle cover.

Further, according to a second aspect of the present invention, in addition to the first aspect, a retaining member that is formed from a resilient material so as to retain a cord, connected to the electronic component, that is inserted therethrough, a cover member that is made of a synthetic resin and is fitted onto the retaining member so as to be in intimate contact with the entire outer periphery of the retaining member within a plane perpendicular to a longitudinal direction of the cord, and the electronic component are embedded in the jacket member by means of insert molding.

Moreover, according to a third aspect of the present invention, in addition to the second aspect, an annular first projection is formed on an inner periphery of a cord insertion hole, provided in the retaining member, through which the cord is inserted, the first projection biting into an outer periphery of the cord, and an endlessly extending second projection is formed on a face that is in contact with the retaining member of the cover member, the second projection biting into the retaining member.

Effects of the Invention

In accordance with the first aspect of the present invention, since the extending portion sandwiched between the abutting parts of the handle main body and the handle cover, which are secured to each other, is provided integrally with the jacket member, which is made of a resilient material, forms part of the electronic component unit housed in the housing recess of the handle main body, and covers at least the electronic component, it is possible to prevent rubbing from occurring between the abutting parts of the handle main body and the handle cover when operating the operating handle, thereby preventing noise from being generated by the rubbing. Moreover, since the extending portion is merely provided integrally with the jacket member, it becomes unnecessary to use an adhesive, thus contributing to a reduction in the cost. Furthermore, since it is unnecessary to carry out an operation of coating with an adhesive, the number of operation steps can be reduced, and since time for curing an adhesive is also unnecessary, it is possible to carry out a subsequent step immediately, thus shortening the operation time.

Furthermore, in accordance with the second aspect of the present invention, since the retaining member, which is made of a resilient material and retains the cord, connected to the electronic component, which is inserted therethrough, and the cover member, which is made of a synthetic resin and is fitted onto the retaining member, are embedded in the jacket member by means of insert molding together with the electronic component, and the cover member is in intimate contact with the entire outer periphery of the retaining member within the plane perpendicular to the longitudinal direction of the cord, it is possible to prevent effectively water from entering the electronic component side. That is, since the jacket member, which is made of a resilient material, and the retaining member, which is made of a resilient material and is covered by the jacket member, would have low intimacy of contact with each other, if left in that state, there would be a possibility that water would enter the electronic component side through a gap between the jacket member and the retaining member if water entered the operating handle from the outside. However, since the cover member, which is made of a synthetic resin, is fitted onto the retaining member so as to be in intimate contact with the entire outer periphery of the retaining member within the plane perpendicular to the longitudinal direction of the cord, it is possible to enhance the intimacy of contact between the jacket member and the cover member whose intimacy of contact with the retaining member has been enhanced, thus making it possible to prevent effectively water from entering the electronic component side.

Moreover, in accordance with the third aspect of the present invention, since the annular first projection formed on the inner periphery of the cord insertion hole of the retaining member bites into the outer periphery of the cord, and the endlessly extending second projection formed on the face of the cover member that is in contact with the retaining member bites into the retaining member, it is possible to enhance the water resistance for the electronic component.

EXPLANATION OF REFERENCE NUMERALS AND SYMBOLS

Figure 1:
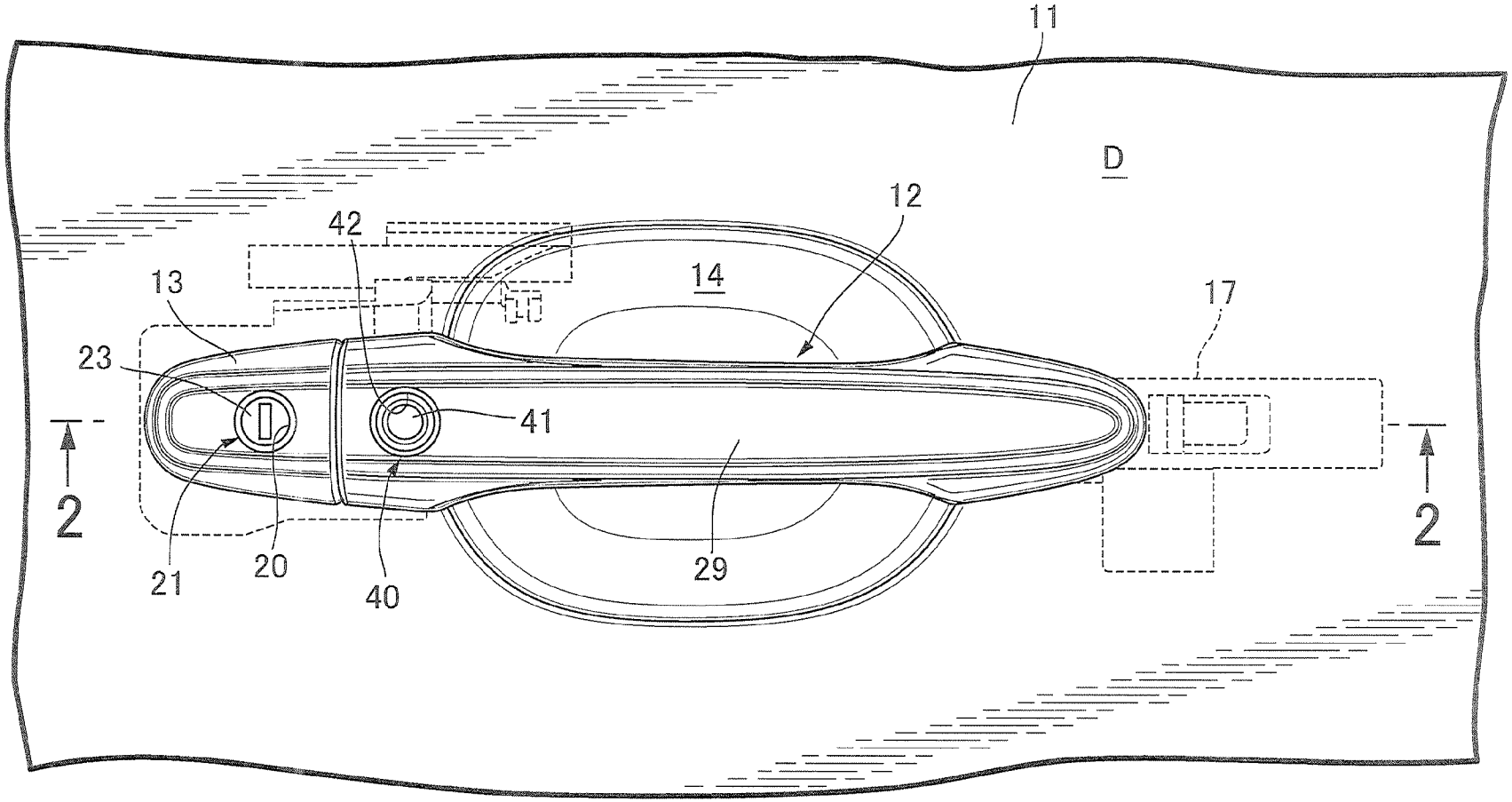
FIG. 1 is a side view of part of a vehicle door. (first embodiment)

12 Operating handle
28 Handle main body
29 Handle cover
30 Housing recess
31 Electronic component unit
34 Jacket member
34*b* Extending portion
35 Electronic component
36 Retaining member
37 Cover member
38 Cord
45 Cord insertion hole
46 First projection
47 Second projection
D Vehicle door

MODES FOR CARRYING OUT THE INVENTION

A mode for carrying out the present invention is explained below by reference to the attached drawings.

First Embodiment

First, in FIG. 1, pivotably mounted on an outer panel 11 of a vehicle door D, which is for example a side door, is an operating handle 12 extending in the fore-and-aft direction (the left-and-right direction in FIG. 1 and FIG. 2) of the vehicle so that it can be operated on the outer face side of the vehicle door D, and mounted thereon is a base member 13 that is made of a hard synthetic resin and is positioned to the rear of the operating handle 12 in the fore-and-aft direction of the vehicle.

Figure 2:
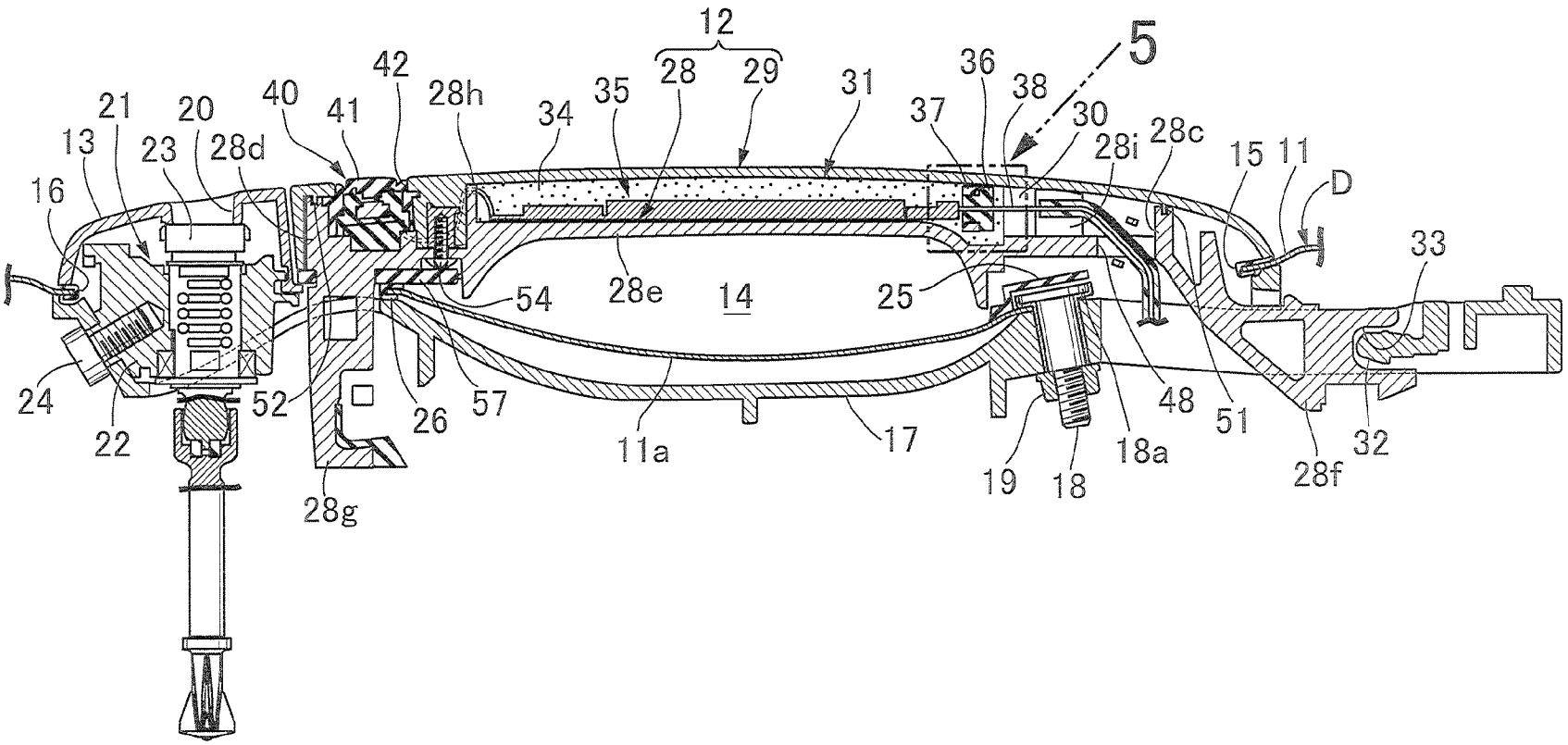
FIG. 2 is a sectional view along line 2-2 in FIG. 1. (first embodiment)

Referring in addition to FIG. 2, provided on the outer panel 11 so as to bulge inward in the vehicle width direction is a curved portion 11*a* forming a depression 14 that enables a hand of a vehicle user gripping the operating handle 12 to be inserted, and also provided therein are a first opening 15 positioned in front of the curved portion 11*a* and a second opening 16 positioned to the rear of the curved portion 11*a*. Furthermore, a handle base 17 extending in the fore-and-aft direction of the vehicle is disposed inward in the vehicle width direction of the outer panel 11. A bolt 18 having an enlarged diameter head portion 18*a* engaged with an outer face of a rear part of the curved portion 11*a* is inserted through the handle base 17. By tightening a nut 19 screwed around a part, projecting from the handle base 17, of the bolt 18 the handle base 17 is fixed to the outer panel 11.

The base member 13 is disposed so as to cover part of the second opening 16. A cylinder body 22 of a cylinder lock 21 whose locking and unlocking is carried out by means of a key (not illustrated) inserted into a key insertion hole 20 provided in the base member 13 is secured to a rear part of the handle base 17 by means of a bolt 24. The base member 13 is mounted on the cylinder body 22. Furthermore, a rotor 23 of the cylinder lock 21 is pivotably supported on the cylinder body 22 at a position corresponding to the key insertion hole 20.

A first seal member 25 covering the enlarged diameter head portion 18*a* of the bolt 18 is mounted on a peripheral edge part of the first opening 15. A second seal member 26 is mounted on a peripheral edge part of the second opening 16, part of the second seal member 26 being sandwiched between the outer panel 11 and the base member 13.

Figure 3:
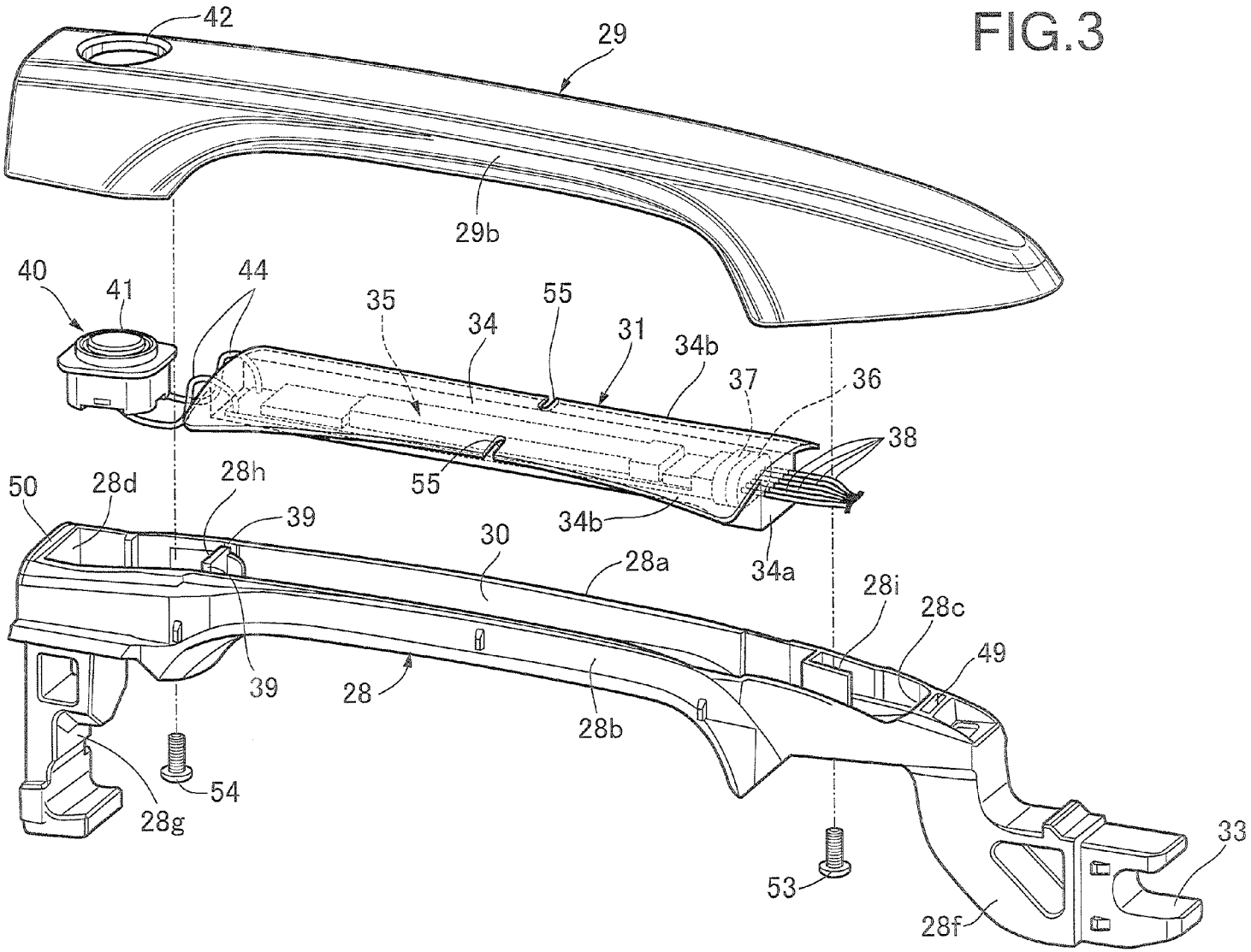
FIG. 3 is an exploded perspective view of an operating handle. (first embodiment)

Referring in addition to FIG. 3, the operating handle 12 includes a handle main body 28 that is formed from a hard synthetic resin, extends in the fore-and-aft direction of the vehicle, and is disposed on an outer face side of the outer panel 11, and a handle cover 29 that is made of a synthetic resin and covers the outer side of the handle main body 28.

The handle main body 28 integrally has a pair of side wall portions 28*a* and 28*b* that extend in the fore-and-aft direction of the vehicle and oppose each other, a front wall portion 28*c* that connects front parts of the two side wall portions 28*a* and 28*b*, a rear wall portion 28*d* that connects rear ends of the two side wall portions 28*a* and 28*b*, a bottom wall portion 28*e* that links parts, on the outer panel 11 side, of the two side wall portions 28*a* and 28*b*, the front wall portion 28*c*, and the rear wall portion 28*d*, a support arm portion 28*f* that has a substantially L-shaped form so as to project into the outer panel 11 from the first opening 15 and is connectedly provided in a front part of the bottom wall portion 28*e*, and an operating arm portion 28*g* that is connectedly provided in a rear part of the bottom wall portion 28*e* so as to project into the outer panel 11 from the second opening 16.

Formed in the handle main body 28 by means of the two side wall portions 28*a* and 28*b*, the front wall portion 28*c*, the rear wall portion 28*d*, and the bottom wall portion 28*e* is a housing recess 30 that has a substantially U-shaped cross-sectional shape opening to the side opposite to the vehicle door D. An electronic component unit 31 is housed in the housing recess 30.

A recess 33 is provided in the support arm portion 28*f* of the handle main body 28, a support part 32 (see FIG. 2) provided on the handle base 17 being inserted into the recess 33, and the support arm portion 28*f* being pivotably supported on the support part 32 of the handle base 17 fixed to the outer panel 11. Furthermore, the operating arm portion 28*g* is linked to a latch mechanism, which is not illustrated. When the vehicle door D is in an unlocked state, by operating the operating handle 12 in a direction in which the operating arm portion 28*g* is pulled toward the outer side of the vehicle door D the latch mechanism releases the closed state of the vehicle door D, thus enabling the vehicle door D to be opened by operation of the operating handle 12. Moreover, with regard to the operating handle 12, the operating arm portion 28*g* is urged by urging means, which is not illustrated, toward the side on which it is pulled toward the inner side of the vehicle door D; in a state in which the operating handle 12 is not operating a front part of the handle cover 29 abuts against the first seal member 25, and a rear part of the handle main body 28 abuts against the second seal member 26 via a resilient member 57 that is fitted into a rear part of the handle main body 28 so as to suppress the generation of noise when the operating handle 12 returns to a non-operating state.

Figure 4:
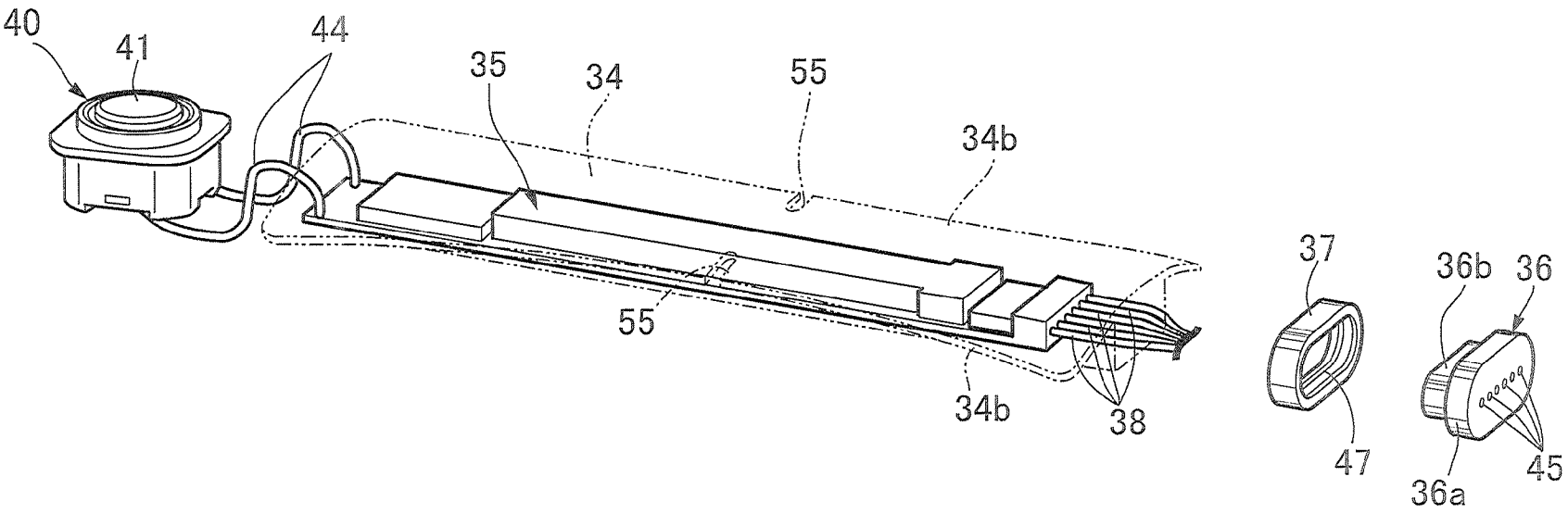
FIG. 4 is an exploded perspective view of an electronic component unit in a state in which a jacket member is omitted. (first embodiment)

Referring in addition to FIG. 4, the electronic component unit 31 is formed by covering at least an electronic component 35 with a jacket member 34. In this embodiment, the electronic component unit 31 is formed by covering with the jacket member 34 formed from a silicone rubber, which is a resilient material, the electronic component 35, a retaining member 36, and a cover member 37. The electronic component 35 is formed by disposing an antenna, a plurality of electrical elements, etc. on a circuit board. The retaining member 36 is formed from a resilient material, for example a rubber material, so as to retain cords 38, which are connected to the electronic component 35, that are inserted therethrough. The cover member 37 is made of a synthetic resin and is fitted onto the retaining member 36 so as to be in an intimate contact with the entire outer periphery of the retaining member 36 in a plane perpendicular to the longitudinal direction of the cords 38. The electronic component 35, the retaining member 36, the cover member 37, and parts of the cords 38 are embedded in the jacket member 34 by means of insert molding when molding the jacket member 34.

A partition wall 28*h* forming slits 39 and 39 between itself and the two side wall portions 28*a* and 28*b* is standingly provided integrally with the bottom wall portion 28*e* of the handle main body 28 in front of the rear wall portion 28*d*. A lock switch 40 is housed in and fixed to the housing recess 30 between the rear wall portion 28*d* and the partition wall 28*h*, the lock switch 40 being for a vehicle user to confirm an intention to lock the vehicle door D. An opening 42 is provided in a rear part of handle cover 29 in the operating handle 12, a switch button 41 of the lock switch 40 facing the opening 42.

Figure 5:
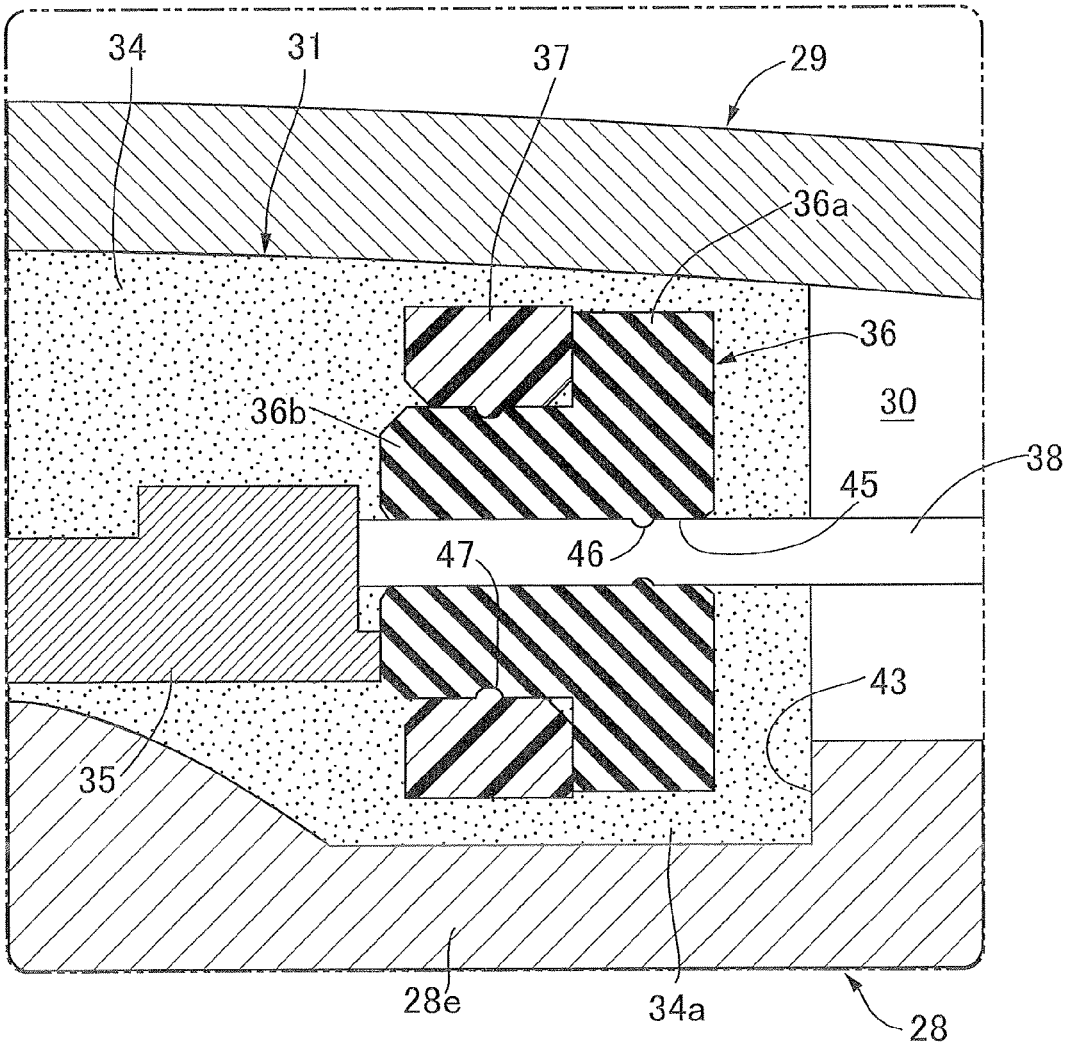
FIG. 5 is an enlarged view of a part shown by arrow 5 in FIG. 2. (first embodiment)

On the other hand, the electronic component unit 31 is housed in the housing recess 30 in front of the partition wall 28*h*. As shown in FIG. 5, a recess 43 is formed in the bottom wall portion 28*e* of the handle main body 28, the recess 43 being for restricting the position of the front end part of the electronic component unit 31 by making a projecting portion 34*a* provided integrally with the jacket member 34 in the electronic component unit 31 engage therewith. The electronic component unit 31 is housed in the housing recess 30 so that the front and rear positions are restricted by the partition wall 28*h* and the recess 43. Moreover, the lock switch 40 is connected to the electronic component 35 of the electronic component unit 31 via a pair of connecting cords 44 and 44. The pair of connecting cords 44 and 44 providing a connection between the lock switch 40 and the electronic component 35, which are disposed so as to sandwich the partition wall 28*h*, are disposed so as to extend through the slits 39 on opposite sides of the partition wall 28*h*.

Figure 6:
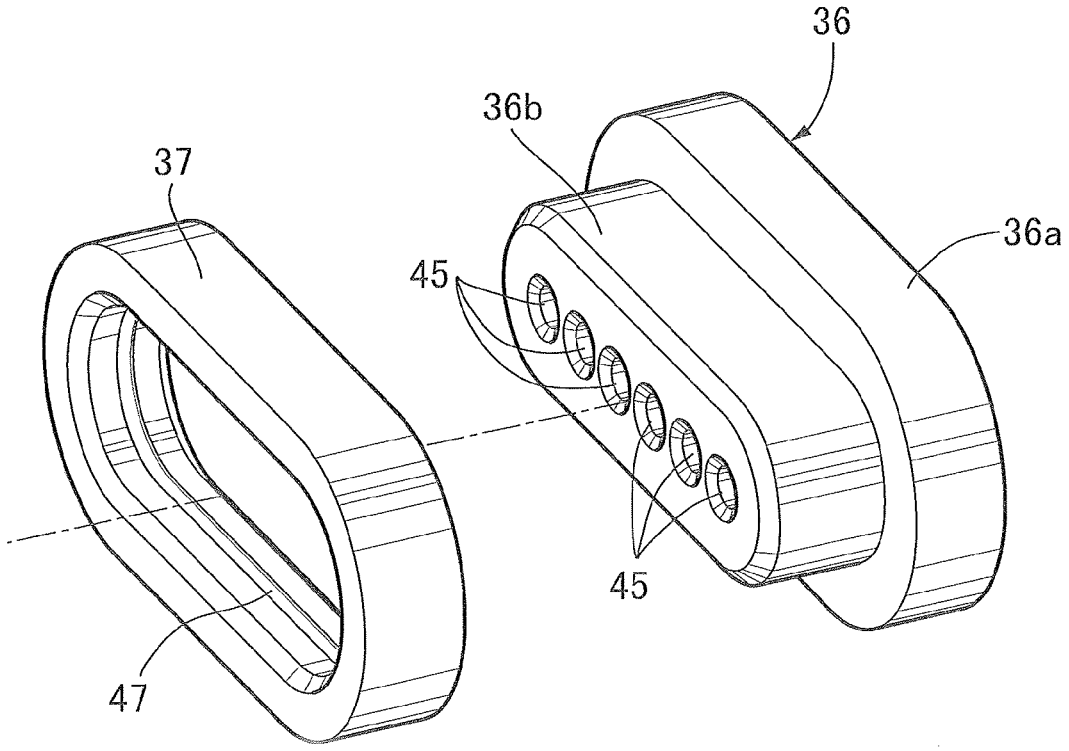
FIG. 6 is an exploded perspective view of a retaining member and a cover member. (first embodiment)

Referring in addition to FIG. 6, the retaining member 36 is formed from a rubber material so as to integrally have a large diameter portion 36*a* and a small diameter portion 36*b*. The large diameter portion 36*a* has an oval cross-sectional shape with a direction joining the two side wall portions 28*a* and 28*b* of the handle main body 28 as the major axis direction. The small diameter portion 36*b* has an oval cross-sectional shape with a direction joining the two side wall portions 28*a* and 28*b* of the handle main body 28 as the major axis direction and is connectedly provided integrally with an end face, facing the electronic component 35 side, of the large diameter portion 36*a* so as to form a step. A plurality of, for example six, insertion holes 45 are provided in the retaining member 36, a plurality of, for example six, cords 38 extending from the electronic component 35 side being individually inserted through the insertion holes 45.

On the other hand, the cover member 37 is formed from a synthetic resin so as to have an oval cross-sectional shape, the inner periphery thereof being in contact with the outer periphery of the small diameter portion 36*b* of the retaining member 36 and the outer periphery thereof being connected to the outer periphery of the large diameter portion 36*a* so as to be flush therewith.

Moreover, annular first projections 46 biting into the outer peripheries of the cords 38 are formed on the inner periphery of the cord insertion holes 45 provided in the retaining member 36, and an endlessly extending second projection 47 is formed on a face, in contact with the retaining member 36, of the cover member 37, that is the inner peripheral face of the cover member 37, the second projection 47 biting into the outer periphery of the small diameter portion 36*b* in the retaining member 36.

The cords 38 inserted through the retaining member 37 are guided, via the first opening 15, to the interior of the vehicle door D from a guide-out hole 48 provided in a part, adjacent to the front wall portion 28*c*, of the bottom wall portion 28*e* of the handle main body 28. Moreover, a wall portion 28*i* is projectingly provided integrally with one, that is, 28*a*, of the two side wall portions 28*a* and 28*b* of the handle main body 28 between the guide-out hole 48 and the electronic component unit 31, the wall portion 28*i* sandwiching the cords 38 between itself and the other side wall portion 28*b* so as to avoid rattling of the cords 38 between the electronic component unit 31 and the guide-out hole 48.

Figure 7:
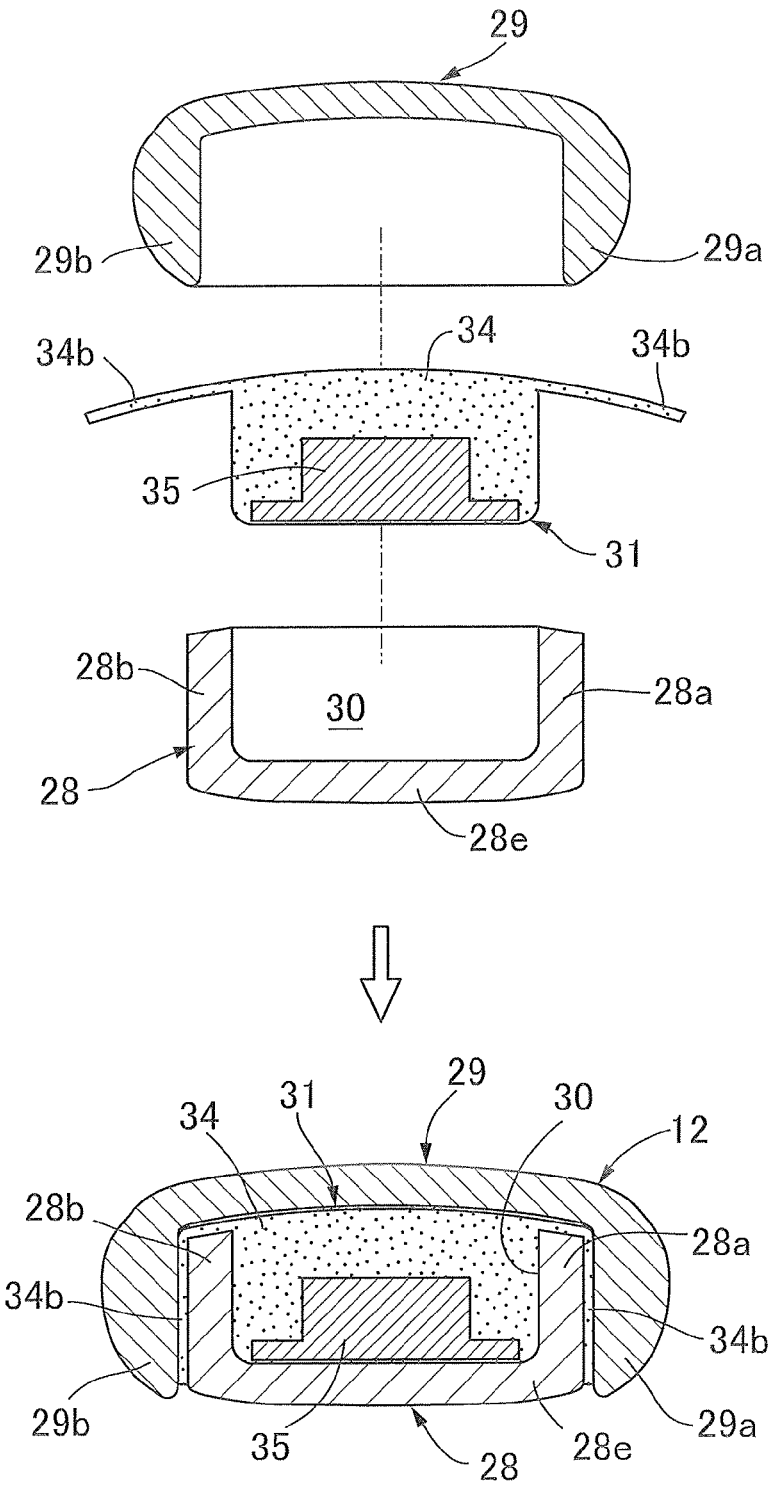
FIG. 7 is a sectional view for explaining a state in which an operating handle is assembled. (first embodiment)

Referring in addition to FIG. 7, the handle cover 29 is formed so as to have a substantially U-shaped cross-sectional shape that opens toward the handle main body 28 side while having a pair of side wall portions 29*a* and 29*b* disposed outside the pair of side wall portions 28*a* and 28*b* of the handle main body 28. In order to position the handle cover 29 relative to the handle main body 28, positioning projections 51 and 52 are projectingly provided on an inner face of the handle cover 29, the positioning projections 51 and 52 being fitted into positioning recesses 49 and 50 respectively provided on the front wall portion 28*a* and the rear wall portion 28*b* of the handle main body 28.

As shown in FIG. 3, a screw member 53 inserted through the front part of handle main body 28 and a screw member 54 inserted through the rear part of the handle main body 28 are screwed into the handle cover 29, and the handle cover 29 is thus secured to the handle main body 28 while covering the housing recess 30.

Extending portions 34*b* and 34*b* are provided integrally with the jacket member 34 of the electronic component unit 31, the extending portions 34*b* and 34*b* extending outward from opposite sides in the width direction of the jacket member 34 so as to protrude from opposite sides of the two side wall portions 28*a* and 28*b* of the handle main body 28 in a state in which the electronic component unit 31 is housed in the housing recess 30 of the handle main body 28 in a state in which it is not covered by the handle cover 29. The extending portions 34*b* and 34*b* are sandwiched between abutting parts of the handle main body 28 and the handle cover 29 in a state in which the handle cover 29 is secured to the handle main body 28 housing the electronic component unit 31 in the housing recess 30, so as to cover the housing recess 30. That is, the two extending portions 34*b* sandwiched between the tip of the two side wall portions 28*a* and 28*b* of the handle main body 28 and the handle cover 29 are bent so as to be present between the two side wall portions 28*a* and 28*b* of the handle main body 28 and the two side wall portions 29*a* and 29*b* of the handle cover 29.

Moreover, cutouts 55 and 55 (see FIG. 3 and FIG. 4) are formed in central parts in the longitudinal direction of the two extending portions 34*b* and 34*b* of the jacket member 34 in order to facilitate bending thereof when bending the two extending portions 34*b* by assembling the handle cover 29 on the handle main body 28 housing the electronic component unit 31 in the housing recess 30.

The operation of this embodiment is now explained. Since the operating handle 12 is formed from the handle main body 28 forming the housing recess 30 and the handle cover 29 secured to the handle main body 28 so as to cover the housing recess 30, the electronic component unit 31 formed by covering at least the electronic component 35 with the jacket member 34 made of a resilient material, for example a silicone rubber, is housed in the housing recess 30, and the extending portions 34*b* sandwiched between the abutting parts of the handle main body 28 and the handle cover 29 are provided integrally with the jacket member 34, it is possible to prevent the occurrence of rubbing between the abutting parts of the handle main body 28 and the handle cover 29 when operating the operating handle 12, thus preventing the generation of noise due to the rubbing. Moreover, since the extending portions 34*b* are merely provided integrally with the jacket member 34, an adhesive is unnecessary, thus contributing to a reduction in the cost. Furthermore, since an operation of coating with an adhesive is not necessary, the number of operation steps can be reduced, and since time for curing an adhesive is also not required, the operation of a subsequent step can be carried out immediately, thus reducing the operation time.

Furthermore, since the retaining member 36 formed from a resilient material, for example rubber, so as to retain the cords 38 connected to the electronic component 35 that are inserted therethrough, the cover member 37 made of a synthetic resin and fitted onto the retaining member 36 so as to be in an intimate contact with the entire outer periphery of the retaining member 36 in the plane perpendicular to the longitudinal direction of the cords 38, and the electronic component 35 are embedded in the jacket member 34 by means of insert molding, it is possible to prevent effectively water from entering the electronic component 35 side. That is, the jacket member 34, which is formed from a resilient material, and the retaining member 36, which is formed from a resilient material covered by the jacket member 34, would have low intimacy of contact with each other, if left in that state, there would be a possibility that water would enter the electronic component 35 side through a gap between the jacket member 34 and the retaining member 36 if water entered the operating handle 12 from the outside, but since the cover member 37 made of a synthetic resin is fitted onto the retaining member 36 so as to be in an intimate contact with the entire outer periphery of the retaining member 36 within a plane perpendicular to the longitudinal direction of the cords 38, it is possible to enhance the intimacy of contact between the jacket member 34 and the cover member 37 whose intimacy of contact with the retaining member 36 is enhanced, thus preventing effectively water from entering the electronic component 35 side.

Furthermore, since the annular first projections 46 biting into the outer periphery of the cords 38 are formed on the inner periphery of the cord insertion holes 45 provided in the retaining member 36 for the cords 38 to be inserted therethrough, and the endlessly extending second projection 47 biting into the outer periphery of the retaining member 36 is formed on the face contacting the retaining member 36 of the cover member 37, that is the inner peripheral face of the cover member 37, it is possible to enhance the water resistance for the electronic component 35.

An embodiment of the present invention is explained above, but the present invention is not limited to the above embodiment and may be modified in a variety of ways as long as the modifications do not depart from the spirit and scope thereof.

The invention claimed is:

1. An external handle device configured for installation on a vehicle door, so as to be operable on an outer face side of the vehicle door when installed thereon, said external handle device comprising:

a handle main body that has formed therein a housing recess having a substantially U-shaped cross section that is open on a side of the handle main body configured for placement opposite to the vehicle door, the handle main body having a curved portion formed therein for placement adjacent to and spaced away from the vehicle door to define a hollow space for accommodating a hand of a user, a handle cover that is secured to the handle main body so as to cover the housing recess, and an electronic component unit formed by covering at least an electronic component with a jacket member, the electronic component housed within the housing recess of the handle main body and comprising a circuit board, the jacket member being formed from a flexibly resilient material and substantially equal in length to the curved portion of the handle main body, wherein at least one extending portion is provided integrally with the jacket member and extending outwardly thereon, the at least one extending portion being sandwiched between abutting parts of the handle main body and the handle cover in an installed configuration of the handle device.

2. The external handle device for a vehicle door according to claim 1, wherein:

a retaining member that is formed from a resilient material and configured so as to retain a cord, connected to the electronic component, that is inserted therethrough, a cover member that is made of a synthetic resin and is fitted onto the retaining member so as to be in intimate contact with the entire outer periphery of the retaining member within a plane perpendicular to a longitudinal direction of the cord, and the electronic component are embedded in the jacket member by means of insert molding.

3. The external handle device for a vehicle door according to claim 2, wherein an annular first projection is formed on an inner periphery of a cord insertion hole, provided in the retaining member, through which the cord is inserted, the first projection pressing into an outer periphery of the cord, and an inwardly extending second projection is formed on a face of the cover member that is in contact with the retaining member, the second projection pressing into the retaining member.

4. The external handle device for a vehicle door according to claim 1, wherein the jacket member is formed from a silicone rubber material.

5. The external handle device for a vehicle door according to claim 1, wherein the at least one extending portion of the jacket member comprises a first extending portion on a first side thereof, and a second extending portion on a second side opposite the first side.

6. An external handle device configured for installation on a vehicle door, said external handle device comprising an operating handle having a housing recess formed internally therein and an electronic component unit disposed inside of the operating handle, the operating handle comprising:

a handle main body that has the housing recess formed therein, the handle main body having a substantially U-shaped cross section that is open on a side of the handle main body configured for placement opposite to the vehicle door, the handle main body having a curved portion formed therein for placement adjacent to and spaced away from the vehicle door to define a hollow space for accommodating a hand of a user, and a handle cover that is secured to the handle main body so as to cover the housing recess, wherein the electronic component unit is formed by insert molding at least an electronic component inside of a jacket member formed from a silicone rubber material, a main body portion of the jacket member is housed within the housing recess of the handle main body, the electronic component comprising a circuit board, wherein the jacket member is substantially equal in length to the curved portion of the handle main body, and wherein a pair of extending portions are formed integrally with the jacket member and extend outwardly on opposite sides of the main body portion thereof, the extending portions being sandwiched between abutting parts of the handle main body and the handle cover in an installed configuration of the handle device.

7. The external handle device for a vehicle door according to claim 6, wherein an annular first projection is formed on an inner periphery of a cord insertion hole provided in the retaining member through which the cord is inserted, the first projection pressing into an outer periphery of the cord, and an inwardly extending second projection is formed on a face of the cover member that is in contact with the retaining member, the second projection pressing into the retaining member.

* * * * *